US006702693B2

(12) United States Patent
Bamber

(10) Patent No.: US 6,702,693 B2
(45) **Date of Patent: *Mar. 9, 2004**

(54) PERIMETER WEIGHTED GOLF CLUBS

(75) Inventor: Jeffrey Vincent Bamber, Cincinnati, OH (US)

(73) Assignee: Pelican Golf, Inc., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/302,197

(22) Filed: Nov. 22, 2002

(65) Prior Publication Data

US 2003/0078114 A1 Apr. 24, 2003

Related U.S. Application Data

(60) Division of application No. 09/967,363, filed on Sep. 28, 2001, now abandoned, which is a continuation of application No. 09/867,245, filed on May 29, 2001, now abandoned, which is a continuation of application No. 09/640,929, filed on Aug. 17, 2000, now abandoned, which is a continuation of application No. 09/144,356, filed on Aug. 31, 1998, now abandoned, which is a continuation of application No. 08/814,939, filed on Mar. 8, 1997, now Pat. No. 5,827,132, which is a continuation of application No. 08/637,860, filed on Apr. 25, 1996, now Pat. No. 5,669,830, which is a division of application No. 08/394,695, filed on Feb. 24, 1995, now Pat. No. 5,540,437, which is a continuation-in-part of application No. 08/213,622, filed on Mar. 15, 1994, now Pat. No. 5,419,560.

(51) Int. Cl.[7] ..... A63B 53/04
(52) U.S. Cl. ..... 473/349; 473/350
(58) Field of Search ..... 473/349, 350

(56) References Cited

U.S. PATENT DOCUMENTS 1,089,881 A 3/1914 Taylor, Jr.
1,128,288 A 2/1915 Churchill (List continued on next page.)

FOREIGN PATENT DOCUMENTS

| | | |
|---|---|---|
| GB | 196133 | 4/1923 |
| GB | 2 005 144 | 4/1979 |
| GB | 2 212 406 | 7/1989 |
| GB | 2251556 | 7/1992 |
| JP | 61-185282 | 8/1986 |
| JP | 7-213656 | 8/1995 |
| JP | 11-146934 | 6/1999 |

OTHER PUBLICATIONS

US D137,281, 5/1944, Newsome (withdrawn)
Palm Springs Golf Company,"Diamonds are Forever" golf iron,Golf Digest, Apr., 1987, p. 128, upper left, The Golf Digest Companies, Trumbull, CT, USA.
Karsten Manufacturing Corporation, Ping Eye advertisement, Golf Digest magazine, Mar., 1981, p. 51, The Golf Digest Companies, Trumbull, CT, USA.

(List continued on next page.)

*Primary Examiner*—Mark S. Graham
(74) *Attorney, Agent, or Firm*—Jeffrey V. Bamber

(57) ABSTRACT

Improved perimeter weighted golf clubs are disclosed. The perimeter weighted golf clubs of the present invention are provided with improved structures for distributing the weight at the perimeter of the club head. In one embodiment, the club is an iron-type golf club having a club head that includes a weighted perimeter portion and at least two spaced apart ribs on the back surface of the club head that extend from an upper portion of the club head toward at least a part of the weighted perimeter portion of the club head and the ribs are oriented generally perpendicular to the upper edge portion of the club head. In one version of this embodiment, the ribs have at least one thinned region therebetween that is in the form of a channel on the back surface of the club head.

44 Claims, 4 Drawing Sheets

U.S. PATENT DOCUMENTS 1,320,163 A 10/1919 Fitz
1,528,017 A 3/1925 Gammeter
1,594,850 A 8/1926 Perkins
1,671,956 A 5/1928 Sime
2,087,685 A 7/1937 Hackney
D115,216 S 6/1939 Newsome
D141,307 S 5/1945 Newsome
2,460,435 A 2/1949 Schaffer
2,691,525 A 10/1954 Callaghan, Sr.
D179,816 S 3/1957 Penna
D179,817 S 3/1957 Penna
D186,986 S 1/1960 Long
D197,524 S 2/1964 Behrendt
D203,936 S 3/1966 Long
3,655,188 A 4/1972 Solheim
3,722,887 A 3/1973 Cochran et al.
D228,355 S 9/1973 Penna
3,814,437 A 6/1974 Winquist
3,845,960 A 11/1974 Thompson
3,847,399 A 11/1974 Raymont
3,888,492 A 6/1975 Cabot
3,897,065 A 7/1975 Solheim
3,947,041 A 3/1976 Barber
D239,778 S 5/1976 Solheim
D240,841 S 8/1976 Solheim
3,995,858 A 12/1976 Cochran et al.
D244,703 S 6/1977 Guzzle et al.
4,213,613 A 7/1980 Nygren
D256,264 S 8/1980 Solheim
4,326,326 A 4/1982 MacDonald
D266,687 S 10/1982 Simmons
D267,965 S 2/1983 Kobayashi
4,420,156 A 12/1983 Campau
4,512,577 A 4/1985 Solheim
4,521,022 A 6/1985 Schmidt
4,534,558 A 8/1985 Yoneyama
4,607,846 A 8/1986 Perkins
4,621,813 A 11/1986 Solheim
4,630,825 A 12/1986 Schmidt et al.
4,671,513 A 6/1987 Swanson
4,754,969 A 7/1988 Kobayashi
4,802,672 A 2/1989 Long
4,826,172 A 5/1989 Antonious
4,848,747 A 7/1989 Fujimura et al.
4,854,581 A 8/1989 Long
4,858,929 A 8/1989 Long
D304,485 S 11/1989 Long
4,883,274 A 11/1989 Hsien
4,884,812 A 12/1989 Nagasaki et al.
4,915,386 A 4/1990 Antonious
4,919,430 A 4/1990 Antonious
4,928,972 A 5/1990 Nakanishi et al.
4,932,658 A 6/1990 Antonious
4,938,470 A 7/1990 Antonious
4,955,610 A 9/1990 Creighton et al.
4,957,294 A 9/1990 Long
4,964,640 A 10/1990 Nakanishi et al.
5,013,041 A 5/1991 Sun et al.
5,014,993 A 5/1991 Antonious
5,016,882 A 5/1991 Fujimura et al.
5,016,883 A 5/1991 Kobayashi
5,026,056 A 6/1991 McNally et al.
D318,703 S 7/1991 Shearer
5,046,733 A 9/1991 Antonious
5,048,834 A 9/1991 Gorman
D321,920 S 11/1991 Parente et al.
5,067,715 A 11/1991 Schmidt et al.
5,074,563 A 12/1991 Gorman
5,082,278 A 1/1992 Hsien
5,110,131 A 5/1992 Long
5,120,061 A 6/1992 Tsuchida et al.
D330,577 S 10/1992 Solheim
5,160,136 A 11/1992 Eger
D332,812 S 1/1993 Solheim
5,190,289 A 3/1993 Nagai et al.
5,193,805 A 3/1993 Solheim
5,230,510 A 7/1993 Duclos
D339,183 S 9/1993 Stites
5,242,167 A 9/1993 Antonious
5,263,717 A 11/1993 McCallister
5,280,911 A 1/1994 Katayama
5,282,625 A 2/1994 Schmidt et al.
D344,778 S 3/1994 Solheim
5,292,122 A 3/1994 Solheim
5,297,803 A 3/1994 Sohheim
5,301,946 A 4/1994 Schmidt et al.
5,312,105 A 5/1994 Cleveland
5,312,106 A 5/1994 Cook
5,316,298 A 5/1994 Hutin et al.
5,316,299 A 5/1994 Feche et al.
5,318,297 A 6/1994 Davis et al.
5,322,285 A 6/1994 Turner
5,326,106 A 7/1994 Meyer
5,328,184 A 7/1994 Antonious
5,330,187 A 7/1994 Schmidt et al.
5,332,223 A 7/1994 Johnson
5,333,860 A 8/1994 Saito et al.
5,333,872 A 8/1994 Manning et al.
5,335,914 A 8/1994 Long
5,344,150 A 9/1994 Schmidt et al.
5,346,216 A 9/1994 Aizawa
5,375,840 A 12/1994 Hirsch et al.
D354,103 S 1/1995 Allen
D354,325 S 1/1995 Henwood
5,377,985 A 1/1995 Ohnishi
5,390,924 A 2/1995 Antonious
5,395,109 A 3/1995 Fenton, Jr.
5,401,021 A 3/1995 Allen
D357,293 S 4/1995 Solheim
D357,294 S 4/1995 Solheim
5,409,229 A 4/1995 Schmidt et al.
D358,188 S 5/1995 Fenton
5,415,406 A 5/1995 Reichenbach et al.
5,419,560 A * 5/1995 Bamber ..... 473/350
5,429,353 A 7/1995 Hoeflich
5,429,354 A 7/1995 Long
5,435,559 A 7/1995 Swisshelm
5,437,456 A 8/1995 Schmidt et al.
D363,100 S 10/1995 Long et al.
5,472,203 A 12/1995 Schmidt et al.
5,485,997 A 1/1996 Schmidt et al.
5,492,327 A 2/1996 Biafore, Jr.
5,505,448 A 4/1996 Park
5,511,786 A 4/1996 Antonious
5,536,011 A 7/1996 Gutowski
5,540,436 A 7/1996 Boone
5,540,437 A 7/1996 Bamber
5,544,885 A 8/1996 Besnard et al.
5,549,297 A 8/1996 Mahaffey
D375,130 S 10/1996 Hlinka et al.
5,586,947 A 12/1996 Hutin
5,595,548 A 1/1997 Beck
5,595,552 A 1/1997 Wright et al.
D379,207 S 5/1997 Besnard et al.
5,643,112 A 7/1997 Besnard et al.
5,669,830 A 9/1997 Bamber
D387,113 S 12/1997 Burrows
5,695,411 A 12/1997 Wright et al.
5,738,596 A 4/1998 Meyer
5,749,795 A 5/1998 Schmidt et al.
5,827,132 A 10/1998 Bamber

| | | | |
|---|---|---|---|
| D425,592 | S | 5/2000 | Sodano et al. |
| D443,665 | S | 6/2001 | Mahaffey |
| D469,833 | S | 2/2003 | Roberts et al. |
| 2002/0107087 | A1 | 8/2002 | Fagot |

OTHER PUBLICATIONS

Karsten Manufacturing Corporation, Ping Eye 2 advertisement, Golf Digest magazine, Mar. 1981, p. 51, The Golf Digest Companies, Trumbull, CT, USA.

Karsten Manufacturing Corporation, Ping Zing advertisement, Golf Digest magazine, Feb., 1993, back cover, The Golf Digest Companies, Trumbull, CT, USA.

Taylor Made Golf Company, Taylor Made ICW II iron advertisement, Golf Magazine, Mar., 1991 pp. 40–41, Time4 Media, Inc., NY, NY, USA.

Austad's, Captain Hook metal woods, Austad's Christmas Catalog (Dec., 1991), p. 43, Austad's, location published unknown.

MacGregor Golf Company, Inc., Mac Gregor RD advertisement (club described in U.S. Patent 5,110,131),Golf World, May 15, 1992, pp. 22–23, The Golf Digest Companies, Trumbull, CT, USA.

Golfsmith, Iron/Wood and Gear Effect Driving Iron advertisement, Golfsmith Holiday Catalog (Dec., 1992), p. 8, Golfsmith, Austin, TX, USA.

Progroup, Inc., Peerless PHD advertisement, Golf Digest, Sep., 1993, insert, unnumbered pages The Golf Digest Companies, Trumbull, CT, USA.

Callaway Golf,Callaway Big Bertha irons advertisement, first date of publication believed to be in 1994 in various golf magazines, Callaway Golf, Carlsbad, CA, USA.

Chris Millard, "Big Irons, Big Money",Golf World, Feb. 18, 1994, pp. 46–69, The Golf Digest Companies, Trumbull, CT, USA.

Rob Saneshaft, "Club Test 94", Golf Magazine, Mar., 1994, pp. 36–40, 42–49, 52–54, 59, 62, 63, 66–68, 72–75, 78, 80, 88–94, and 96–102, Time4 Media, Inc., NY, NY, USA.

Herrington Co., Callaway Big Bertha irons,Herrington Catalog, Spring, 1994, pp. 3 & 4, Herrington Co, Londonderry, NY, USA.

Golfsmith, O/S Project Oversize irons advertisement, May, 1994 Catalog, p. 7, Golfsmith, Austin, TX, USA.

Golf World Magazine,"Big is Still Beautiful", Spalding Top–Flite Magna, Golf World magazine, Sep. 9, 1994, Bunker to Bunker column, p. 4 The Golf Digest Companies, Trumbull, CT, USA.

Golfsmith,The Golf Store from Golfsmith, Holiday, 1994, Chi Chi's Distance Secret, p. 26. (This device is believed to have been marketed for several years.), Golfsmith, Austin, TX, USA.

Lynx Golf, Inc., Lynx Black Cat iron brochure, copyrighted 1995, Lynx Golf, Inc, City of Industry, California, USA.

Falcon Golf, Falcon Fatboy "Fat and Gutless" advertisement,Golf Digest, Feb., 1995, insert, unnumbered page The Golf Digest Companies, Trumbull, CT, USA.

Golf Digest, Feb., 1995, "Evolution of a Clubhead", pp. 110–114 The Golf Digest Companies, Trumbull, CT, USA.

Detroit Free Press, Feb. 21, 1995, Golf article on Fatboy equipment maker.

The Detroit News, Mar. 2, 1995, Golf article on Fatboy equipment maker.

Falcon Golf, Falcon Fatboy "Fatboy. The Inside Story" advertisement, Golf Digest, May, 1995, p. 75 The Golf Digest Companies, Trumbull, CT, USA.

Lynx Golf, Inc., Lynx Black Cat Stability Weighted Iron advertisement, Golf World Magazine, May 12, 1995, p. 5, The Golf Digest Companies, Trumbull, CT, USA.

Karsten Manufacturing Corporation, Ping ISI advertisement, Golf World, Jan. 12, 1996, back cover, The Golf Digest Companies, Trumbull, CT, USA.

Nils Nelson, "Equipment Update", description of Ping ISI iron series (introduced just before Christmas, 1995), LINK-S–The Best of Golf magazine, Apr., 1996, p. 80, Purcell Enterprises, Inc., Hilton Head Island, SC, USA.

Nicklaus Golf Equipment Company, L.C., Nicklaus Air Bear advertisement, Golf World, Apr.5, 1996, pp. 80–82, The Golf Digest Companies, Trumbull, CT, USA.

Pal Joey Golf Company, St Irons, Pal Joey Golf Catalog obtained at 1997 PGA Trade Show, Jan., 1997, p. 3, Pal Joey Golf Company, Newark, OH, USA.

Mark Wilson, Dunlop MAXFLI Max 357 irons (sold between 1984–1988), The Golf Club Identification & Price Guide IV, 1950–1998, published Nov., 1999, p. 17–3, Ralph Maltby Enterprises, Inc., Newark, OH, USA.

Kevin Cook, "Choose Your Weapons" (showing Ping Eye 2 Plus iron sold in 1989), Maximum Golf Magazine, Feb., 2001, p. 54, Maximum Golf, NY, NY, USA.

Mark Wilson, MacGregor MT irons (sold between 1976–1978), The Golf Club Identification & Price Guide IV, 1950–1998, published Nov., 1999, p. 28–32 to 28–34, Ralph Maltby Enterprises, Inc., Newark, OH, USA.

Rob Sauerhaft, "Club Test 2002", Cleveland TA7 Micro-Cavity iron,Golf Magazine, May, 2002, p. 152, Time4 Media, Inc., NY, NY, USA.

Dynacraft Golf Products, Inc., Team Dynacraft irons, Dynacraft Holiday Corner golf product mailing, Nov./Dec., 2002, p. 3, Dynacraft Golf Products, Inc., Newark, OH, USA.

Diamond Tour Golf Wholesalers, Inc., Tour Response 900 irons, Diamond Tour Golf 2002/2003 catalog, p. 4, Diamond Tour Golf Wholesalers, Inc., DeKalb, IL, USA.

Mark Wilson, Yamaha Accurace irons (sold in 1989), The Golf Club Identification & Price Guide III, 1950–1998, published Nov., 1999, p. 47–46, Ralph Maltby Enterprises, Inc., Newark, OH, USA.

Unknown Author and pulbication date, Additional photo of a Dave Pelz DP–1 Featherlite iron (sold in 1984).

Golfsmith, The Ultimate Clubmakers Catalog 2003, Spalding CustomBlack Hawk iron heads, p. 49, Golfsmith, Austin, TX, USA.

Mark Wilson, Dave Pelz DP–1 Lajet Classic Featherlite irons (sold in 1984), The Golf Club Identification & Price Guide IV, 1950–1998, published Nov., 1999, pp. 34–1 to 34–4, Ralph Maltby Enterprises, Inc., Newark, OH, USA + Additional photo of a dave Pelz iron.

* cited by examiner

PERIMETER WEIGHTED GOLF CLUBS

This application is a division of application Ser. No. 09/967,363 filed Sep. 28, 2001, abandoned, which was a continuation of application Ser. No. 09/867,245 filed May 29, 2001 (now abandoned), which was a continuation of application Ser. No. 09/640,929 filed Aug. 17, 2000 (now abandoned), which was a continuation of application Ser. No. 09/144,356 Filed Aug. 31, 1998 (now abandoned), which was a continuation of application Ser. No. 08/814,939 filed Mar. 8, 1997 (now U.S. Pat. No. 5,827,132), which was a continuation of application Ser. No. 08/637,860 filed Apr. 25, 1996 (now U.S. Pat. No. 5,669,830), which was a division of application Ser. No. 08/394,695 filed Feb. 24, 1995 (now U.S. Pat. No. 5,540,437), which was a continuation-in-part of application Ser. No. 08/213,622 filed Mar. 15, 1994 (now U.S. Pat. No. 5,419,560).

FIELD OF THE INVENTION

This invention relates to golf clubs, more particularly to golf club heads. More particularly still, this invention relates to perimeter weighted golf clubs that have improved structures for distributing the weight at the perimeter of the club head.

BACKGROUND OF THE INVENTION

In golf club design, iron golf clubs have undergone an evolution. Irons originally had relatively flat "blade" club heads.

The design of iron-type golf clubs then evolved into club heads of the "cavity back" type. Cavity back designs involve taking the weight from the center of the club head and redistributing it to the toe and heel portions of the club head While leaving a cavity behind the hitting area. Irons having a cavity back design which have been marketed on a wide scale by Karsten Mfg. of Phoenix, Ariz. under the trademark "PING" are described in U.S. Pat. Nos. 3,655,188, 3,897,065, the patent issued out of application Ser. No. 07/620,521 on Apr. 23, 1985, and U.S. Pat. No. 4,621,813, all issued to Solheim. While the irons sold under the trademark "PING" have been highly successful, the search for improved perimeter weighted iron club head designs has continued.

more recently, the design of wood and iron-type golf club heads has been directed to so-called "oversized" club heads. Examples of such clubs are BIG BERTHA metal woods manufactured by Callaway Golf of Carlsbad, Calif., BIG HEAD oversized metal woods and irons manufactured by Head of Fort Worth, Tex., DOCTOR oversized irons manufactured by MacGregor of Albany, Ga., KING COBRA oversized metal woods and irons manufactured by Cobra Golf, Inc. of Carlsbad, Calif., and KILLER WHALE metal woods manufactured by Wilson Sporting Goods of Chicago, Ill.

There is room for improvement in the design of all of the aforementioned clubs. For example, one drawback in these clubs is that the perimeter weighting is not distributed as efficiently as it could potentially be distributed. Another drawback is that the appearance of these clubs is such that the player might tend to believe that using such clubs will result in a sliced shot due to the fact that many of these iron club heads have portions that fan out from the rear of the toe of the club head.

The design of iron clubheads is governed by Rule 4-1d in Appendix II of the rules of the United States Golf Association (the "USGA"). Rule 4-1d requires-that:

The clubhead shall be generally plain in shape. All parts shall be rigid, structural in nature and functional.

Features such as holes through the head, windows or transparancies, or appendages to the main body of the head such as plates, rods, or fins for the purpose of meeting dimensional specifications, for aiming or for any other purpose are not permitted.

Golf clubs must meet the requirements of the USGA to be considered "legal" for tournament play.

Thus, a need exists for improved perimeter weighted golf clubs clubs that conform to the requirements of the Rules of Golf of the USGA. In particular, a need exists for perimeter weighted golf clubs that have improved appearance and improved structures for distributing the weight around the perimeter of the club head.

These and other objects of the present invention will be more readily apparent when considered in reference to the following description and when taken in conjunction with the accompanying drawings.

SUMMARY OF THE INVENTION

The present invention relates to improved perimeter weighted golf clubs, particularly those of the iron type. It should be understood, however, that the same principles can also be applied to the design of "metal" wood type clubs. The perimeter weighted golf clubs of the present invention are provided with improved structures for distributing the weight around the perimeter of the club head.

The first basic embodiment of the golf club of the present invention has a club head having a club face with a hitting surface and a spacer outboard of the hitting surface which connects the hitting surface and the weighted perimeter portion of the club head. The spacer allows the weighted perimeter portion of the club head to be disposed further outward from the hitting surface than in current cavity back clubs to increase the efficiency of the perimeter weighting. The spacer can be any suitable structure, such as a thinned portion or a lighter weight portion of the club head. The aforementioned embodiment of the present invention can also provide an "oversized" iron club head without substantially increasing the mass of the club head.

In a second basic embodiment, the golf club comprises an iron or a metal type wood club head with a main body (or frame) at least a portion of which is tubular. In a particularly preferred version of this embodiment, the tubular portion of the frame is a flattened tubular structure. The tubular frame provides a strong structure that is much lighter in weight than perimeter weighted golf clubs of the type described in the aforementioned patents. This allows a larger club head to be created without the mass of current perimeter weighted clubs.

In these or other embodiments, the club head can have a structure that facilitates the desired rotation of the club face when the club is swung. A non-limiting number of additional features which can be incorporated into these embodiments and a non-limiting number of additional embodiments are also described herein.

BRIEF DESCRIPTION OF THE DRAWINGS

While the specification concludes with claims particularly pointing out and distinctly claiming the present invention, it is believed the invention will be better understood from the following description taken in conjunction with the accompanying drawings.

DETAILED DESCRIPTION OF THE INVENTION

I. First Basic Embodiment

Figure 1:
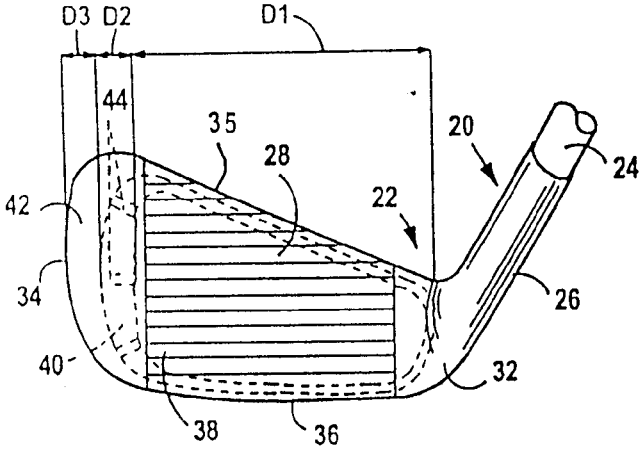
FIG. 1 is a front elevational view of the club head of the present invention which is provided with a spacer between the hitting surface and the weighted perimeter portion.
Figure 2A:
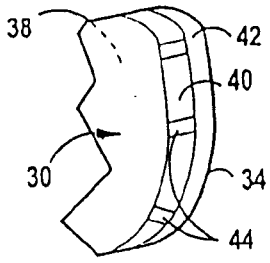
FIG. 2A is a fragmentary rear elevational view of a portion of an alternative version of the club head shown in FIG. 2 in which the weighted perimeter portion is disposed only along the toe of the club head.
Figure 2:
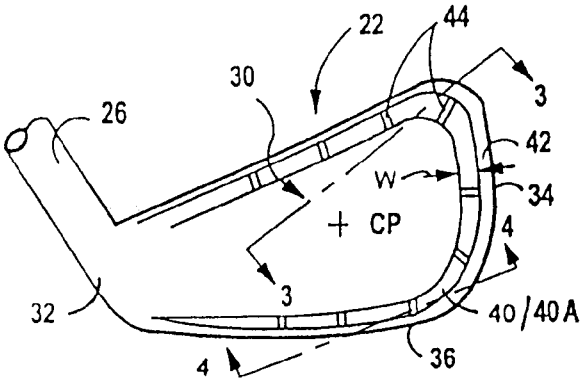
FIG. 2 is a rear elevational view of the club head shown in FIG. 1.
Figure 3:
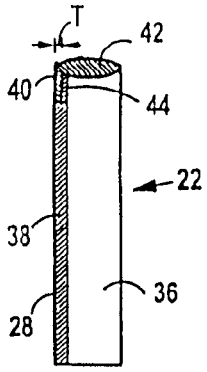
FIG. 3 is a cross sectional view taken along line 3—3 of FIG. 2.

FIGS. 1–3 show a first embodiment of the improved perimeter weighted golf club 20 of the present invention which has an iron-type club head. The golf club comprises a club head 22 and a shaft 24. The club head 22 comprises a hosel 26 connected to the lower end of the shaft 24. The hosel 26 is integrally formed with the club head. In addition to the hosel 26, the club head 22 includes a club face 28, a back surface 30, a heel or heel portion 32, a toe or toe portion 34, a top edge or ridge 35, and a sole 36.

The club head 22 further comprises a club face 28 with a hitting surface 38; a spacer, such as a thinned portion 40, outboard of the hitting surface 38; and, a weighted perimeter portion 42. The term "outboard", as used herein, refers to locations that are spaced away from the center of percussion of the club head, CP. The weighted perimeter portion 42 may, but need not surround the entire perimeter of the hitting surface 38. FIG. 2A shows an alternative embodiment of the present invention in which the weighted perimeter portion 42 is disposed only around a portion of the perimeter of the hitting surface 38. Preferably, the weighted perimeter portion 42 is disposed at least along at least a portion of the toe 34 of the club head. Preferably, as shown in FIG. 2A, the weighted perimeter portion 42 is disposed at least along the entire toe 34 of the club head.

The thinned portion 40 connects the hitting surface 38 and the weighted perimeter portion 42 of the club head. The thinned portion 40 spaces the weighted perimeter portion 40 away from the hitting surface. It is for this reason that the thinned portion 40 may be referred to as a "spacer".

The thinned portion 40 generally has a thickness, T, that is thinner than at least some portions of the hitting surface 38. Often, the hitting surface 38 will have a relatively uniform thickness so the thinned portion 40 will be thinner than all portions of the hitting surface 38. The thinned portion 40 may, thus, be thinner than either an adjacent portion of the hitting surface, or thinner than the thinnest portion of the hitting surface. Preferably, the thinned portion 40 will be at least one of the following amounts thinner than the adjacent portion of the hitting surface, or the thinnest portion of the hitting surface, or both: about 0.01 inch (0.25 mm), about 0.02 inch (0.5 mm), about 0.03 inch (0.76 mm), . . . , etc. (by "etc.", it is meant any larger 0.01 inch (0.25 mm) unit increment). The larger differences in thickness will have a greater effect on the distribution of the weight within the club head. FIG. 3 shows that in cross-section, the thinned portion 40 may be flush with the hitting surface 38. The weighted perimeter portion 42 shown in FIG. 3 has a thickness greater than both the thinned portion 40 and the hitting surface 38.

FIG. 2 shows that the width of the thinned portion, W, may vary. For example, the width of the thinned portion may be greater along the toe 34 of the club head than at the sole or at the top edge of the club head. Alternatively, the width of the thinned portion may be uniform around the perimeter of the hitting surface 38. In alternative embodiments, the width of the thinned portion 40 (and the width of the weighted perimeter portion 42) may vary from club to club to provide a correlated set of clubs within which set each club has an optimal weight distribution.

The thinned portion 40 may, but need not be thick enough to withstand the impact of the club head hitting a golf ball. This is possible because of several factors. First, the thinned portion 40 is preferably disposed far enough outward of the hitting surface 38 so that even the worst mis-struck shots will not contact the thinned portion 40. This aspect of the invention may be described in terms of the relative dimensions of various portions of the club head.

For example, the hitting surface 38 may have a maximum width, D1, measured parallel to the sole 36 of the club from the a point adjacent the hosel 26 where the curvature of the hosel ends (and the flat hitting surface 38 begins) to the beginning of the thinned portion 40. The club head also has a distance D2 equal to the width of the thinned portion 40, and a distance D3 equal to the width of the weighted perimeter portion 42 which are both measured at the point of maximum width of the club head in a direction parallel to the sole 36 of the club.

Without wishing to be bound to any particular dimensions, the maximum width, D1, of the hitting surface 38 may, for example, range from a size that is sufficiently small so that the overall maximum width of the club head (D1+D2+D3) is only approximately the same as the width of a conventional blade-type iron (e.g., for a 5 iron, the overall maximum width of the club head may be about 2.75 inches (7 cm)), or less, to a size that is greater than or equal to the total width of any currently used clubs, including oversized clubs (so that the distance D1 itself is equal to the size of such current clubs e.g., D1 itself is greater than or equal to about 2.75 inches (7 cm), 3 inches (7.6 cm), 3.25 inches (8.25 cm), 3.5 inches (8.9 cm), . . . , etc.) in which case the inner dotted line in FIG. 1, representing the hitting surface 38, is equal in size to any such currently used clubs.

For the purpose of determining the actual size of currently used clubs, the dimensions of the clubs described in the patents incorporated by reference herein and the clubs described in the Feb. 18, 1994 issue of *Golf World* magazine and the March, 1994 issue of *Golf Magazine*, as well as their manufacturer's specifications are incorporated by reference herein. The loft of such iron club heads are preferably greater than or equal to about 15 degrees, more preferably greater than or equal to about 17 degrees for a one iron. The width D2 of the thinned portion 40 may, for example, then be about ⅛ inch (3 mm), ¼ inch (6 mm), ½ inch (1.3 cm), ¾ inches (2 cm), 1 inch (2.5 cm), or more. The width D3 of the weighted perimeter portion 42 may, for example be in about the same range as those widths given for the width D2 of the thinned portion 40, but D2 and D3 need not be the same.

Second, if the thinned portion 40 is not disposed far enough away from the hitting surface 38 to avoid mis-struck shots, the thinned portion 40 may be made narrow enough in width that the impact of the ball is absorbed by a portion of the hitting surface 38 and a portion of the weighted perimeter portion 42. In such a case, the thinned portion 40 merely bridges these other portions of the club head that are absorbing the impact.

Third, in the embodiment shown in FIGS. 1–3, the thinned portion 40 may be reinforced against the forces created by the impact with a golf ball. The thinned portion 40 may be reinforced by one or more reinforcing members 44 that extend between the hitting surface 38 and the weighted perimeter portion 42. The reinforcing member (or members) 44 may be in any suitable configuration. The reinforcing member(s) 44 may be provided on either the club face 28 side of the club head, on the back surface 30 of the club head 22, or both. In one non-limiting embodiment shown in FIGS. 1 and 2, these reinforcing members are disposed radially around the hitting surface 38 on the back surface 30 of the club head. The reinforcing members 44 may be comprised of the same material (e.g., metal) as the remaining portions of the club head 22. In other embodiments, the thinned portion 40 may be reinforced by a material that is different from the material comprising the remainder of the club head 22. For instance, the thinned portion 40 could be reinforced by a lighter (i.e., less dense) material, such as a plastic, an acoustic aerospace elastomer that is heat fitted to the remainder of the club head, or a different kind or alloy of metal. Such a reinforcing material can be placed adjacent all of the thinned portion (or spacer) 40, or only a portion thereof.

Fourth, in other embodiments, such as those shown in the following figures, the thinned portion 40 may be offset backward from the hitting surface 38 and the weighted perimeter portion 42 so that the thinned portion 40 never comes in contact with the golf ball.

The thinned portion 40 allows the weighted perimeter portion 42 of the clubhead 22 to be disposed further outward from the hitting surface 38 than in current cavity back clubs to increase the efficiency of the perimeter weighting. The efficiency of the perimeter weighting is increased because the moment arm between the weighted perimeter portion 42 and the hitting surface 38 is longer than in conventional cavity back clubs in which the weighted perimeter is immediately adjacent to the hitting surface or behind the hitting surface. In other words, the first embodiment of the present invention separates the weighted perimeter portion 42 from the hitting surface 38 and moves it outward where it can be more effective.

The aforementioned embodiment of the present invention also may be used to provide an "oversized" iron club head without substantially increasing the mass of the club head.

The embodiment of the invention shown in FIGS. 1–3 also has the advantage that it can be manufactured relatively easily and inexpensively by any suitable casting process well known to those of skill in the art of golf club making. Alternatively, the club head can be made by any other means for making golf clubs, such as by forging and the like. The club head can be made of any materials commonly used for golf clubs, including but not limited to iron, steel, graphite, titanium, and the like. It is also possible that portions of the club head can be made out of one material and other portions out of one or more other materials.

Figure 4:
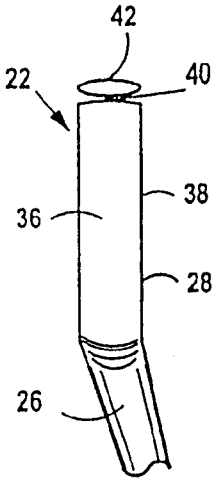
FIG. 4 is a cross-sectional view of an alternative embodiment taken along line 4—4 of FIG. 2 showing the sole of the club head and a section of the weighted perimeter portion of the club head.
Figure 5:
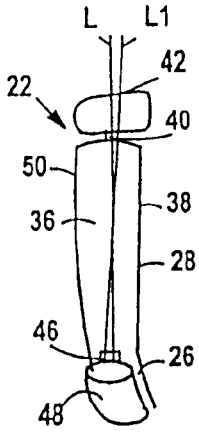
FIG. 5 is another alternative embodiment of a golf club head taken along a cross-section similar to that of FIG. 4 which has a weighted perimeter portion that is located at least partially forward of the hitting surface.

FIGS. 4 and 5 show several non-limiting alternative versions of the first basic embodiment of the present invention. FIG. 4, for instance, shows a version of the first embodiment in which the thinned portion 40 is offset backward from the hitting surface 38. In other embodiments, the thinned portion 40 can be disposed forward of the hitting surface 38. However, such embodiments are generally not preferred.

FIG. 5 shows a highly preferred version of the first embodiment of the present invention in which at least a portion of the weighted perimeter portion 42 of the club head 22 is disposed forward of the hitting surface 38 of the club face. (It should be noted that more conventional club heads can be provided in such a configuration, and that such club heads are also within the scope of this aspect of the present invention, but that it works particularly well with the club head of the present invention.) This is a highly preferred feature of the present invention for a number of reasons.

Providing the club head with such a configuration provides a club head that appears to the golfer as though it fans forward toward the target rather than out from the rear of the toe of the club head as is the case in all current perimeter weighted golf clubs. This gives the club face the appearance of having a concave (or spoon-like) overall shape rather than a convex overall shape like current perimeter weighted clubs such as the PINC ZING. Such a feature is believed to be highly useful in building confidence of the golfer that the club will not produce sliced shots.

The structure of the club head shown in FIG. 5 allows a portion of the weighted perimeter portion to be distributed in front of the hitting surface. This is believed to further increase the effectiveness of the club head in several ways. This weight distribution facilitates rotation of the toe of the club head relative to the heel through impact so as to square the club head and produce a straight shot or a shot with a slight draw.

Placement of the weight in such a manner is completely opposite of those methods currently used to attempt to achieve squaring of the club head at the ball. An example of one recent attempt to achieve such squaring of the club head is the PEERLESS PHD golf club manufactured by ProGroup, Inc. shown in the September, 1993 issue of Golf Digest and described in U.S. Pat. No. 5,335,914 issued to Long on Aug. 9, 1994. The PEERLESS PHD golf club employs an extension of the hosel in a direction opposed to the toe of the club (i.e., toward the golfer when in his or her stance) to attempt to achieve "Maximum Perimeter weighting" by positioning the weight a "full inch further from the center of gravity than traditional perimeter weighting will allow" to provide a greater moment of inertia (or resistance to twisting on off-center hits).

Without wishing to be bound by any particular theory, it is believed that providing weight in the toe of the club should be more effective in producing the desired rotation of the club head because the golf swing involves the application of centrifugal force and a larger mass in the toe will speed rotation of the toe of the club and increase the force applied by the toe.

The version of the club head shown in FIG. 5 is able to aid in achieving such rotation without interfering with the golfer's shot. This is due to the fact that the weighted perimeter portion 42 is not used in striking the ball. Ordinarily, providing a club head with a concave portion at the toe of its hitting surface would produce a shot that flies far left of target if this portion of the club head contacted the ball, but since it is spaced apart from the hitting surface, the weighted perimeter portion should not contact the ball. Thus, the ball will be contacted by the hitting surface 38 and will generally rotate or spin straight up the club face rather than laterally to the side of the hitting surface 38 toward the weighted perimeter portion 42.

The principles of the various embodiments of the present invention, as discussed above, can also be applied to "wood" clubs, particularly "metal woods". The spacer 40 and the weighted perimeter portion 42, in such a case, can be located inside the metal shell that ordinarily forms the body of a metal wood club, or outside such a shell, or comprise part of the metal shell.

Various other alternative embodiments of the first basic embodiment of the club head of the present invention, or features thereof, are possible.

In one alternative embodiment, for example, the thinned portion 40 of the club head can be extremely thin (e.g., thin as sheet metal), or even omitted in which case there will be a hole where the thinned portion ordinarily is, and the weighted perimeter portion 42 will simply be connected to the hitting surface by the reinforcing members 44. In such an embodiment, the holes can be filled with another type of spacer (such as a lighter material) disposed between the reinforcing members 44.

In another alternative embodiment, instead of comprising a "thinned portion", the spacer 40 that connects the weighted perimeter portion 42 to the hitting surface 38 can, as alternatively shown in FIG. 2, comprise a lighter weight portion 40A. The lighter weight portion 40A has a lower density than the adjacent portion (or other relevant portion) of the hitting surface 38. Such a lighter weight portion may be, but need not be, thinner than the hitting surface 38, or the relevant portion thereof. Thus, it is possible to have a spacer 40 that is as thick as, or thicker than, the relevant portion of the hitting surface 38, yet still serve a spacing function because it is lighter in weight than the adjacent portion of the hitting surface 38.

The lighter weight portion 40A can be made of a material that is similar to the material comprising the hitting surface 38 (e.g., may also be a metal). Alternatively, the lighter weight portion 40A can be made of a material that is completely different from the type of material comprising the hitting surface 38. For example, the hitting surface 38 and the weighted perimeter portion 42 could comprise a metal, and the lighter weight portion 40A could comprise a plastic, an aerospace acoustic elastomer, or a different kind or alloy of metal.

In still other alternative embodiments, as shown in FIG. 5, the club head of the present invention can be provided with a weighted perimeter portion as described above, and a weighted hosel portion 48 extending in a direction opposed to the hosel 26 in which an element like the so-called POWER WEDGE of the PEERLESS PHD clubs serves as a hosel spacer 46 for the weighted hosel portion 48. This can be used to create a club head with true maximum perimeter weighting.

In a particularly preferred version of such an embodiment, the weighted perimeter portion 42 at the toe 34 of the club head 22 can be disposed at least partially forward of the hitting surface 38 as described above, and the weighted hosel portion 48 of the club head can be disposed rearward of the longitudinal centerline, L1 of the club head so that the two weighted portions define an axis L1 that is rotated clockwise from the longitudinal centerline of the club head when the club head is viewed from the sole 36 to further aid in achieving maximum rotation through the ball. Any of these embodiments can further be combined with a structure in which the back edge 50 of the sole of club head is convex outward to provide the golfer with additional confidence that the club will not produce sliced shots.

In addition, the club head 22 can be provided with some other type of structure that facilitates the desired rotation of the club face 28 when the club 20 is swung. This structure can be an airfoil or other means for achieving (the desired) rotation of the club head through the ball striking portion of the golfer's swing. There are several ways this can be done. FIGS. 7–10, show several non-limiting ways of achieving such rotation. Before discussing FIGS. 7–10, it is instructive to first examine the typical prior art design shown in FIG. 6.

Figure 6:
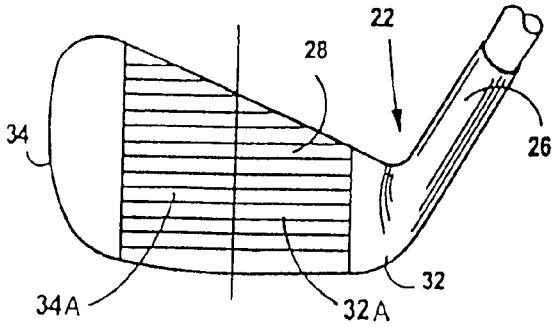
FIG 6 (PRIOR ART)
FIG. 6 is a front elevational view of a typical prior art club head.

Currently, as shown in FIG. 6, in known iron club head designs, the surface area of the club face 28 is much larger from the center of percussion CP to the toe 34 of the club than it is from the center of percussion CP to the heel 32 of the club. These areas are referred to as toe part (or "toe half", though it need not comprise exactly ½ of the club head) 34A and heel part (or "heel half") 32A in FIG. 6. The current designs are intended to provide club face surface area where impact with the golf ball is most likely to occur. However, such designs provide an aerodynamic shape that is exactly opposite of the shape that would be needed to provide the desired rotation through the ball striking area of the golfer's swing. In these prior art designs, the greatest wind resistance or "drag" is applied to the toe half 34A when the club is swung due to its larger surface area. The greater amount of drag acting upon the toe half 34A of the club head, tends to make it more difficult to close the toe 34 of the club during the golfer's swing, and thus, to achieve the desired rotation of the club head through the ball striking area.

FIGS. 7–9, and 10 show two possible ways of providing a club head with a shape that will counteract the tendency for the greatest amount of drag to be exerted on the toe 34 of the club head 22.

Figure 7:
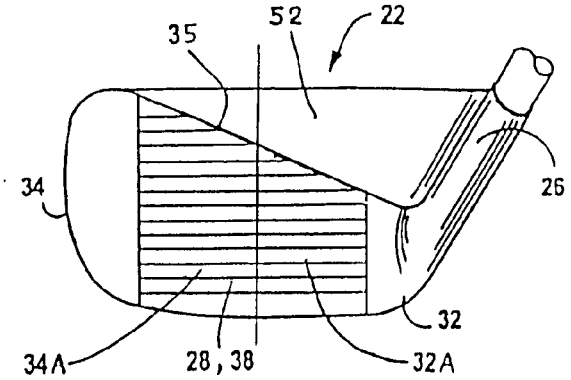
FIG. 7 is a front elevational view of an alternative embodiment of the club head of the present invention which is provided with an extension of the top edge of the club head.

FIG. 7 shows a club head 22 in which the heel half 32A of the club head 22 is provided with a larger surface area than the toe half 34A of the club head. This is achieved by providing at least a portion of the club head (and preferably, at least the heel half 32A of the club head) with an extension 52 that runs from the top edge 35 of the club head to the hosel 26. This extension 52 can be made extremely thin and light weight so that it does not add appreciably to the overall weight of the club head. It may be made of the same material as the rest of the club head, or it may be made of a different material. The extension need not be strong enough to withstand an impact with the golf ball since a golf ball would typically not be hit with this portion of the club head.

Figure 8:
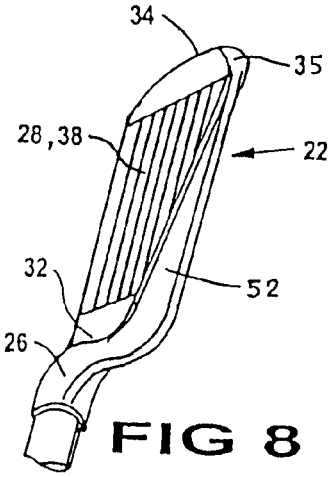
FIG. 8 is a top view of the club head shown in FIG. 7.

The extension 52 of the top edge 35 of the club head 22 of the present invention shown in FIG. 8 is preferably generally rearwardly sloping. Even more preferably, the extension 52 aligns with the slope of the rest of the club face 28 so that it does not obstruct or alter the golfer's view of the golf ball or the rest of the club face when the golfer is looking at the club face from above and addressing the golf ball. Further, in such a case, the extension 52 can even be tapered to provide the club head with a top edge that has the appearance of being even thinner the club head would be without the extension.

Figure 9:
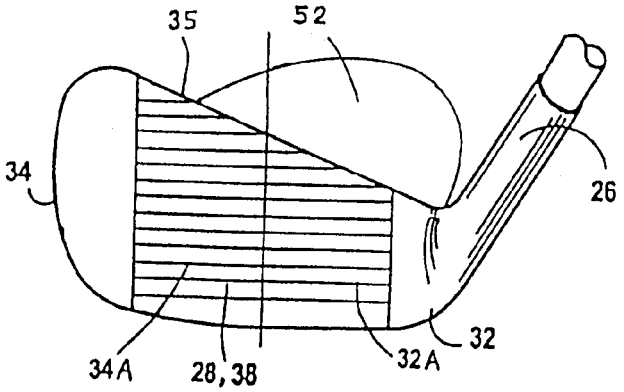
FIG. 9 is a front elevational view of an alternative embodiment of a club head which is provided with an extension of the top edge of the club head.

As shown in FIG. 9, in still other embodiments, the extension 52 of the top edge 35 of the club head 22 need not even be connected to the hosel 26 of the club. The extensions 52 of the top edge 35 of the club head is also not limited to the specific shapes shown in the drawings.

Figure 10:
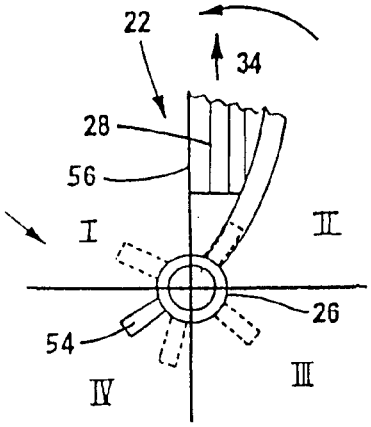
FIG. 10 is a partially fragmented top view of the heel and hosel of the club head showing various locations for an extension of the hosel.

FIG. 10 shows an embodiment in which the club head 22 has a different type of structure that will counteract the tendency for the greatest amount of drag to be exerted on the toe 34 of the club head 22. The club head 22 in FIG. 10 is provided with a generally rearward extension 54 of the hosel 26 similar to that previously shown in FIG. 5. However, in the embodiment shown in FIG. 10, the extension 54 of the hosel may, but need not have a great enough weight to significantly redistribute the overall weight of the club head. For example, the extension 54 of the hosel 26 can generally very thin like the extension of the top edge of the club head shown in the preceeding drawing figures. The extension 54 of the hosel 26 is preferably sized so that it will alter the effect of drag on the heel 32 of the club head. The extension 54 of the hosel 26 need only be thick enough so that it does not break when the club is swung.

As discussed above, U.S. Pat. No. 5,335,914 discloses a golf club having a hosel weight that extends outwardly from the hosel. The hosel weight is located within a 90 degree segment of the outer periphery of the hosel. The extension 54 of the hosel 26 described herein is distinguishable in that it comprises an airfoil that need not significantly redistribute the weight of the club head and which may extend outward from any of the remaining 270 degree portions of the hosel. FIG. 10 shows that there can be four possible 90 degree segments around the hosel 26. These areas are designated, proceeding clockwise around the hosel 26 shown in FIG. 10 a first 90 degree segment I, a second 90 degree segment II, a third 90 degree segment III, and a fourth 90 degree segment IV.

The first 90 degree segment I is bounded by a plane that extends forward of and generally at right angles to the lower leading edge 56 of the club head 22 to a plane which extends toward the toe 34 of the club head in a direction generally parallel to the lower leading edge 56 of the club head. The second 90 degree segment II is bounded by a plane which extends toward the toe 34 of the club head 22 in a direction generally parallel to the lower leading edge 56 of the club head to a plane that extends rearwardly generally at right angles to the lower leading edge 56 of the club head 22. The third 90 degree segment III is bounded by a plane which extends rearwardly generally at right angles to the lower leading edge 65 of the club head to a plane that extends outwardly from the rear of the hosel 26 in a direction opposite the toe 34 of the club head 22 generally parallel to the lower leading edge 56 of the club head 22. The fourth 90 degree segment is bounded by a plane which extends outwardly from the rear of the hosel 26 in a direction opposite the toe 34 of the club head generally parallel to the lower leading edge 56 of the club head to the plane extends forward of and generally at right angles to the lower leading edge 56 of the club head 22.

Preferably, this extension 54 of the hosel is at least in the fourth 90 degree segment IV illustrated in FIG. 10. This will allow the wind resistance on the airfoil provided thereby to act like a revolving door in gradually closing the club face 28 as the club head 22 is swung through impact as shown by the arrow in FIG. 10. In still other embodiments, the hosel 26 can be provided with a plurality of such airfoils that are spaced radially around the hosel (or otherwise suitably arranged) to increase the revolving door effect. Several possible locations for such additional extensions 54 are shown in phantom in FIG. 10.

The aforementioned embodiments are directed to providing the club head 22 with some type of structure that preferably alters the flow of air around the club head so that the toe 34 of the club head is capable of moving at least as fast as the heel 32 of the club head, and preferably faster than the heel, without any deliberate attempt by the golfer to manipulate the club head to close the club face. This can be analogized to the flow of air across an airplane wing wherein the air must travel around a longer path on the upper surface of the wing than on the lower surface of the wing to create lift. This embodiment of the present invention is not limited to the structures shown in the drawings. Any other structures which alter the flow of air around the club head 22 so that it has a longer path (and more particularly, a longer sum total of all paths) around the heel part of the club are also within the scope of the present invention.

In still other alternative embodiments, the hitting surface 38 of the club head can be provided with a bulge similar to a Wood for further compensating for mis-struck shots.

The improved perimeter weighted golf clubs of the present invention should comply with the Rules of the USGA because the various spacer portions of the club head are integral parts of the club head which are structural as well as functional.

II. Second Basic Embodiment

Figure 11:
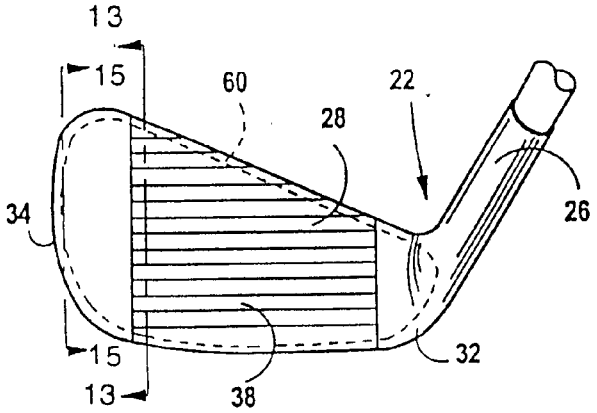
FIG. 11 is a front elevational view of the club head of the second basic embodiment of the present invention which is provided with a tubular frame.
Figure 17:
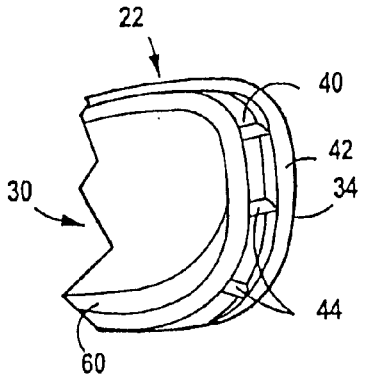
FIG. 17 is a fragmentary perspective view of the rear of a club head which is provided with a weighted perimeter portion outboard of the tubular frame.
Figure 12:
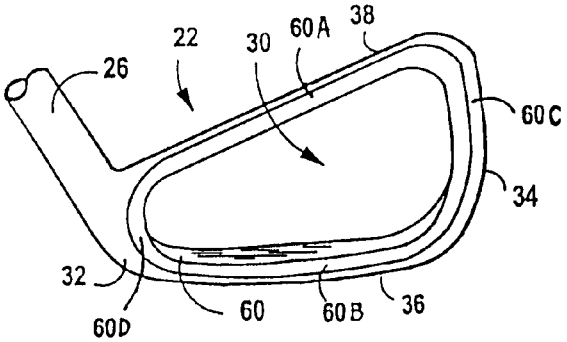
FIG. 12 is a back elevational view of the club head shown in FIG. 11.

FIGS. 11–17 show that in another basic embodiment, the golf club 20 comprises a club head 22 with a main body (or frame) 80 that has at least a portion which is tubular. FIGS. 11 and 12 show the basic structure of such a club head 22. The tubular frame 60 preferably supports the hitting surface 38 and is preferably located outboard at least a portion of the hitting surface 38.

Figure 15:
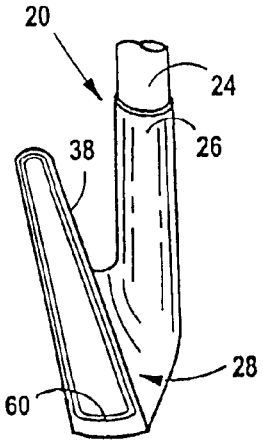
FIG. 15 is a cross sectional view of a club head like that shown in FIG. 11 only having a flattened tubular frame as it would appear from a section taken along line 15—15 of FIG. 11.

The tubular frame 60 may have any suitable cross-sectional shape. The cross-sectional shape of the tubular frame 60 may, for example, be circular, oval, a flattened oval, square, triangular, rectangular, or irregularly shaped. In the particularly preferred versions of this embodiment shown in most of the drawing figures, the tubular portion of the frame is a flattened tubular structure. FIG. 15 shows an embodiment in which the tubular structure has a rectangular cross-sectional shape.

The frame of the club head is preferably tubular around the entire periphery of the hitting surface 38. However, as indicated above, it is also possible for only portions of the frame to be tubular. For example, the tubular frame may comprise one or more of the following tubular portions: a top tubular portion 60A (that is disposed adjacent at least the top portion of the hitting surface), a bottom tubular portion 60B (that is disposed adjacent the bottom or sole portion of the hitting surface), a tubular portion adjacent to the toe portion of the hitting surface 60C, and a tubular portion adjacent to the heel portion of the hitting surface 60D. As shown in the drawings, the tubular portions are preferably positioned either at least partially behind the hitting surface 38, at least partially outboard of the hitting surface, or both.

The tubular structure, even if only partially disposed around the hitting surface 38, provides a strong frame that is much lighter in weight than perimeter weighted golf clubs of the type described in the aforementioned patents (which have a solid metal frame). This allows a much larger club head to be created without the mass of current perimeter weighted clubs.

Figure 13:
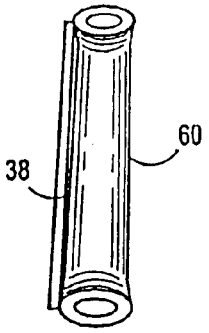
FIG. 13 is a cross sectional view of the club head shown in FIG. 11 taken along line 13—13 of FIG. 11.
Figure 14:
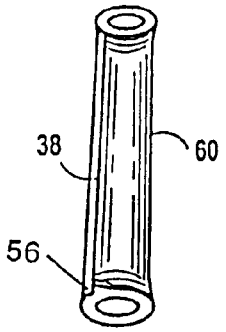
FIG. 14 is a cross sectional view of the club head shown in FIG. 11 having an alternative construction.

FIGS. 13 and 14 show two possible ways that the club face 28 may be affixed to the tubular frame 60. FIG. 13 shows an embodiment in which the entire back of club face 28 is attached to the front of the tubular frame (such as by being formed integrally with the tubular frame, by being attached by welding, or the like). FIG. 14 shows an embodiment in which the club face 28 is set into a portion of t:he tubular frame like an insert. U.S. Pat. No. 4,884,812 issued to Nagasaki, et al. and U.S. Pat. No. 5,282,625 issued to Schmidt, et al. show various ways that could be used for setting the club face 28 into the tubular frame.

The tubular frame 60 can be hollow, or it can be filled with a material or substance. If the tubular frame is filled with a material, the material chosen is preferably lighter weight than the material comprising the frame. Such a lighter weight material can be any suitable material, with foams being preferred. In one preferred embodiment, the tubular frame 60 can be filled with a structural polyurethane foam similar to the material advertised as being suitable for use in the door frames of LEXUS automobiles.

The tubular frame 60 can be made of any suitable material commonly used in the construction of golf clubs. The material used in the frame may, but need not be of a type of material or of a thickness that all portions of the frame are able to withstand a direct impact with a golf ball. For instance, the tubular frame 60 may be comprised of graphite similar to current oversize tennis racquets (in which the strings withstand the impact and the frame merely serves to support the strings).

However, portions of the tubular frame, for instance, such as the leading edge 56 of the club at the bottom of the sole, can be made thick enough as shown in FIG. 14, or reinforced to withstand impact with a golf ball.

Figure 16:
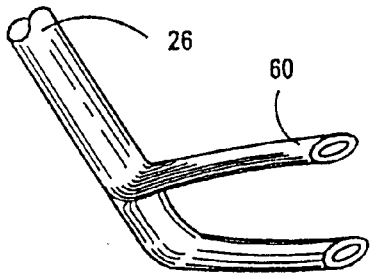
FIG. 16 is a fragmentary perspective view showing how the tubular frame of the club head might be fashioned from an extension of the hosel.

The tubular frame 60 can be made by any suitable method. For instance, the tubular frame can be cast, injection molded, or it can be extruded, or made by any of the technologies commonly used in making pipes. Alternatively, the tubular frame 60 can be made by any methods known for use in making golf club shafts. In addition, FIG. 16 shows that in one embodiment, the frame 60 can comprise an extension of the shaft or hosel of the club. In such a case, the hollow hosel 26 can be formed into a loop-like structure and secured to itself to form the frame 60. In still other embodiments, the frame 60 can be made by any of the technologies described in the patent literature for making "wide body" tennis racquets out of graphite and the like.

Figure 18:
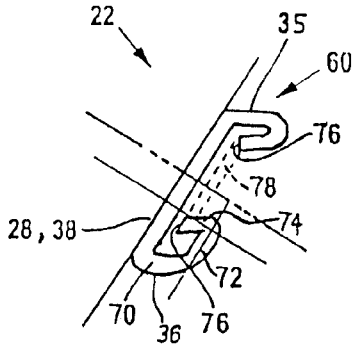
FIG. 18 is a cross-sectional view of one embodiment of an iron club head having a partially tubular frame.

The frame of the club head 22 can also define only a part of a tubular structure. The partially tubular structure defined by the frame can take many possible forms. FIG. 18 shows one example of an iron having a partially tubular structure. The frame 60, when seen in cross-section, can have portions, 70, 72, and 74, that comprise of straight segments, curvilinear segments, or both. The cross-section of the partially tubular frame shown in FIG. 18 can be thought of as defining an arc. In this case, the arc subtends an angle that is greater than about 180 degrees. Preferably, the arc defined by the frame subtends an angle that is greater than or equal to about 180 degrees plus any of the possible 5 degree incremental amounts above 180 degrees up to 360 degrees, including by way of example, 270 degrees. Another way to describe this arc is in terms of the angle that the frame turns in cross-section relative to the club face 28. (A circular arc of 360 degrees would comprise a completely tubular structure.) Generally, it is believed that the larger the angle formed by the partially tubular structure is, and the closer it comes to a completely tubular structure, the more stable the club head 22 will be.

The angles referred to above can be measured by using the rearwardly inclined club face 28 as a reference, particularly when the club head is in a ball-addressing position as shown in FIG. 18. The angles are turned from the reference line shown in FIG. 18 in the direction of the ends 76 of the partially tubular section. If, as shown in FIG. 18, the partially tubular section has a segment 72 in cross-section that is "doubled back" so that it runs parallel to the club face 28, this segment 72 is considered to be oriented at an angle of 180 degrees to the reference line. If the partially tubular section contains a segment 74 that turns an additional 90 degree angle toward the club face 28 from the aforementioned segment 72, this latter partially tubular section of the frame will be considered to define an angle of 270 degrees. It should be understood that it is not necessary for all portions of the frame to form the same portion of a completely tubular structure. It is possible for different portions of the frame to define differing degrees of a completely tubular structure.

In addition, the ends 76 of the segments disposed on opposite sides of the club head 22 (that is, on the top and bottom, or on the toe and heel) can be unattached to any other pact of the club head, or they can, be connected to each other as shown by the lines in phantom. Connecting the ends 76 of the segments (such as by a back plate 78) can be used to provide the club head 22 with added stability, and keep debris from collecting in the back 30 of the club head.

Figure 19:
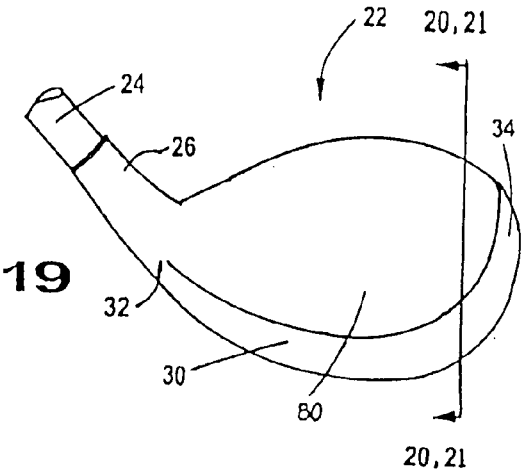
FIG. 19 is a rear elevational view of a "metal wood" club head.
Figure 20:
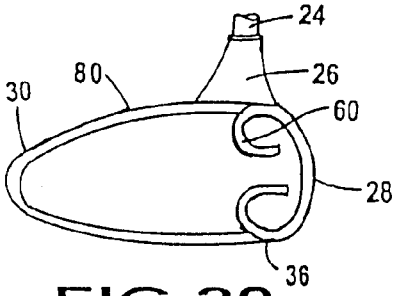
FIG. 20 is a cross-sectional view of one embodiment of a metal wood-type club head which has a partially tubular frame.
Figure 21:
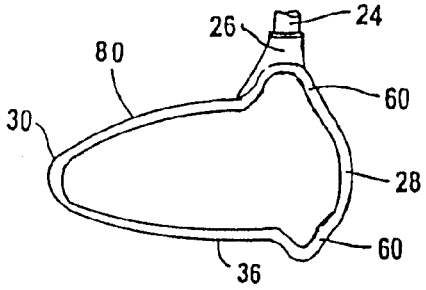
FIG. 21 is a cross-sectional view of another embodiment of a metal wood-type club head which has a partially tubular frame.

FIGS. 19–21 show several non-limiting examples of a metal wood having a tubular or partially tubular structure.

The tubular or partially tubular frame and any weighted perimeter portion 42, in such a case, can be located inside the metal (or other material) shell 80 that ordinarily forms the body of a metal wood club, or outside such a shell, or comprise part of the metal shell. FIG. 20 shows one non-limiting example of a metal wood structure where a partially tubular frame is located inside the metal shell 80 that forms the body of the metal wood. FIG. 21 shows a non-limiting example of a metal wood structure where a partially tubular frame is located at least partially outside of the metal shell 80 that forms the body of the metal wood.

Figure 22:
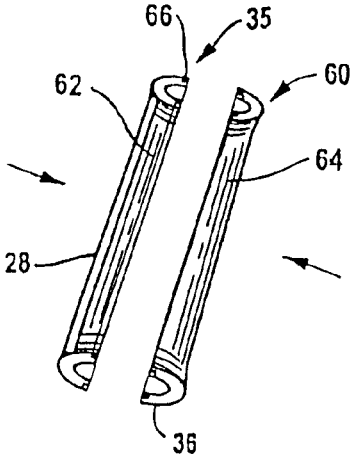
FIG. 22 is a simplified cross-sectional view showing one method of assembling a club head having a tubular frame.
Figure 23:
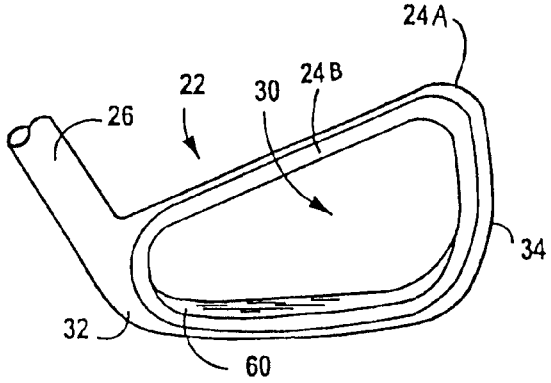
FIG. 23 is rear elevational view showing the components of a club head having a tubular frame, which have been assembled in another way.

FIGS. 22 and 23 show several ways of making a club head having a tubular structure. The club head 22 with the tubular frame 60 may, for example, be cast in one or more pieces. There are several ways of casting a club head with a tubular frame.

FIG. 22 shows one way of casting an iron club head with a tubular frame. In FIG. 22, the club head can be cast in two pieces. The pieces 62 and 64 are shown to be generally equal in size (that is, each piece forms approximately half of the tubular frame). However, as the following drawing figures show, it is not necessary for the pieces that form the tubular frame to each form approximately half of the tubular structure.

The pieces 62 and 64 can each be made using a mold which has a male side and a female side. Preferably, the pieces 62 and 64 are provided with a guide, such as the lip 66 shown in FIG. 22 that can be used to align the two pieces during the assembly of the pieces of the club head. After the pieces 62 and 64 are aligned, they are secured together, such as by welding them together.

FIG. 23 shows one possible alternative assembly of a golf club head with a tubular frame that utilizes pieces that are substantially different in the portion of the tubular frame that each forms. In FIG. 23, the piece designated 24A forms the largest portion of the tubular frame. This piece, 24A, can be made using a single mold which is designed to fit around a separate water soluable ceramic insert that fits in the interior of the mold and is dissolved away in order to form the hollowed out portion inside the larger piece 24A. The piece designated 24B forms the smaller portion of the tubular frame. The embodiment shown in FIG. 23 provides the advantage that it allows a tubular frame to be made with a smaller amount of welding and with welding which is only on one side of the tubular frame.

In other alternative embodiments, the tubular frame could be cast around a material that remains in place in the finished club head. For instance, the tubular frame could be cast around a ceramic coated material, that is preferably light weight and remains in the club. Such materials may include ceramic coated foams and ceramic coated acoustic aerospace elastomers. in optional versions of such processes, all or a portion of the material inside the frame could be removed after the club head is cast or otherwise formed.

FIG. 23 can also be used to show a way of assembling a club head having a tubular frame which involves making a portion of the tubular frame out of a different material. In FIG. 23, the piece designated 24A which forms the largest portion of the tubular frame is preferably made out of a strong material such as a metal that is formed by investment casting a 17-4 stainless steel. The piece designated 24B which forms the smaller portion of the tubular frame can be made out of another material, such as plastic. The piece 24B need not be made strong enough to withstand impact with a golf ball. It is preferably structurally strong, rigid, and lightweight so that it can complete the formation of the tubular structure. This embodiment provides the advantage that it only requires one of the pieces of the frame to be made by the more expensive investment casting process. The piece 24B can be made by a less expensive method, such as injection molding. The piece 24B can be joined to the metal piece 24A in any suitable manner, such as by providing a lip on part of the metal piece 24A and snapping the plastic piece 24B in place thereon. The plastic piece 24B can, but need not, serve to stabilize the club against vibrations as described in U.S. Pat. No. 5,316,298.

In still other embodiments, the club head 22 with the tubular frame 60 could be made out of graphite using using a form fitting latex bladder or balloon that is inflated under high pressure. The graphite could be wrapped around the inflated bladder and placed under sufficient external pressure so that it takes the shape of the bladder. The bladder could then be deflated and removed. The applicable pressures and the like would be similar to those used to make Taylor Made's "Bubble" golf club shaft described in U.S. Pat. No. 5,316,299 issued to Feche, et al. on May 31, 1994. The procedure for making Taylor Made's shaft is described in greater detail in the January, 1995 issue of Petersen's *Golfing* magazine. It is expressly not admitted, however, that either of these publications teaches or discloses the club head of the present invention, or a method of making the same.

Various additional versions of the second embodiment are also possible. The second embodiment of the improved perimeter weighted golf club head of the present invention can, for example, be provided with any of the features described in this specification as being suitable for use on the first basic embodiment. FIG. 12 shows an example of such an embodiment where the tubular club head is provided with a weighted perimeter portion 42 that is spaced away from the frame by a thinned portion 40.

Figure 24:
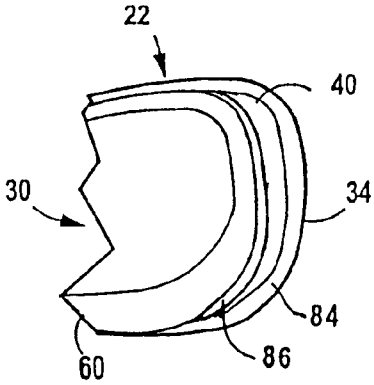
FIG. 24 is a fragmentary perspective view of the rear of a club head which has another structure for distributing the weight of the club head at the outer edge of a tubular frame.

FIG. 24 shows that in another alternative embodiment, a similar, though less dramatic, distribution of the weight of the club head could be achieved by simply making the outer (or distal) wall 84 of the tubular frame thicker than the inner wall 86.

The disclosures of all patents and publications mentioned throughout this patent application are hereby incorporated by reference herein. It is expressly not admitted, however, that any of the documents incorporated by reference herein teach or disclose the present invention. It is also expressly not admitted that any of the commercially available materials or products described herein teach or disclose the present invention.

While particular embodiments of the present invention have been illustrated and described, it would be obvious to those skilled in the art that various other changes and modifications can be made without departing from the spirit and scope of the invention. (For example, most of the discussion herein was directed to weighting a club head so that a counter clockwise rotation through the ball could be achieved for a right handed golfer. It is also within the scope of the present invention to arrange the weighting in a directly opposite manner to achieve the opposite type of rotation if a golfer desires.)

What is claimed is:

1. An iron-type golf club comprising a golf club head having a club face, a back surface, said club head comprising a heel, a toe, and a sole extending generally between said heel and said toe, an upper edge portion, a weighted perimeter portion which forms at least a portion of the perimeter of said club head, and at least one rib on the back surface of said club head that extends from an upper portion of said club head toward at least part of the weighted perimeter portion at the upper portion of the club head wherein said club head comprises a thinned region on the back surface of said club head, said thinned region being formed by a recess on the back surface of said club head that is disposed at least along the upper portion of said club head.

2. The golf club of claim 1 wherein said at least one rib is oriented generally perpendicular to the upper edge portion of said club head.

3. The golf club of claim 2 wherein said thinned region is adjacent to said at least one rib, and comprises two channel portions one of which is disposed on either side of said at least one rib.

4. The golf club of claim 3 wherein said channel portions are oriented generally parallel to the upper edge portion of said club head.

5. The golf club of claim 3 wherein there are three channel portions that are oriented generally parallel to the upper edge portion of said club head.

6. The golf club of claim 4 wherein said channel portions are elongated and at least some of said channel portions have sides that are generally rectilinear.

7. The golf club of claim 6 wherein the sides of said channel portions are generally parallel to each other.

8. The golf club of claim 3 wherein at least one channel portion on the back surface of said club head has curvilinear sides.

9. The golf club of claim 3 wherein said channel portions have a length, and at least one rib is oriented generally perpendicular to the length of said channel portions.

10. The golf club of claim 4 wherein said channel portions have a length and a width, and said at least one rib has a length, and the length of said channel portions is greater than the length of said at cast one rib.

11. The golf club of claim 3 wherein said channel portions have a length and a width, and said at least one rib has a length, and the length of said at least one rib is substantially the same as the width of the channel portions.

12. The golf club of claim 1 wherein said thinned region has a width of about ⅛ inch.

13. An iron-type golf club comprising a golf club head having a club face, a back surface, said club head comprising a heel, a toe, and a sole extending generally between said heel and said toe, an upper edge portion, a weighted perimeter portion which forms at least a portion of the perimeter of said club head, and at least two spaced apart ribs on the back surface of said club head that extend from an upper portion of said club head toward at least part of the weighted perimeter portion at the upper portion of the club head wherein said club head comprises a thinned region on the back surface of said club head, said thinned region being formed by a recess on the back surface of said club head that is disposed at least along the upper portion of said club head.

14. The golf club of claim 13 wherein said ribs are oriented generally perpendicular to the upper edge portion of said club head.

15. The golf club of claim 13 wherein at least a portion of said thinned region is positioned between said ribs.

16. The golf club of claim 13 wherein at least a portion of said thinned region is oriented generally parallel to the upper edge portion of said club head.

17. The golf club of claim 16 wherein said thinned region comprises at least two channel portions that arc oriented generally parallel to the upper edge portion of said club head, and one of said channel portions is positioned between said ribs, and another channel portion is disposed to the side of one of said ribs.

18. The golf club of claim 17 wherein said channel portions are elongated and at least some of said channel portions have sides that are generally rectilinear.

19. The golf club of claim 18 wherein the sides of said channel portions are generally parallel to each other.

20. The golf club of claim 17 wherein said club head comprises at least one additional channel portion on the back surface of said club head that has curvilinear sides.

21. The golf club of claim 20 wherein the upper edge portion of said club head curves to merge with the toe of said club head, and said additional channel portion is located in the region where the upper edge portion of said club head curves to merge with the toe of said club head.

22. The golf club of claim 17 wherein said channel portions have a length, and at least one rib is oriented generally perpendicular to the length of said channel portions.

23. The golf club of claim 17 wherein at least one channel portion on the hack surface of said club head has curvilinear sides.

24. The golf club of claim 17 wherein said channel portions have a length and a width, and said at least one rib has a length, and the length of said channel portions is greater than the length of said at least one rib.

25. The golf club of claim 17 wherein said channel portions have a length and a width, and said at least one rib has a length, and the length of said at least one rib is substantially the same as the width of the channel portions.

26. The golf club of claim 13 wherein said thinned region has a width of about ⅛ inch.

27. An iron-type golf club comprising a golf club head having a club face, a back surface, said club head comprising a heel, a toe, and a sole extending generally between said heel and said toe, an upper edge portion, a weighted perimeter portion which forms at least a portion of the perimeter of said club head, and at least three spaced apart ribs on the back surface of said club head that extend from an upper portion of said club head toward at least part of the weighted perimeter portion at the upper portion of the club head wherein said club head comprises a thinned region on the back surface of said club head, said thinned region being formed by a recess on the back surface of said club head that is disposed at least along the upper portion of said club head.

28. The golf club of claim 27 wherein said ribs are oriented generally perpendicular to the upper edge portion of said club head.

29. The golf club of claim 27 wherein said thinned region comprises at least two channel portions that are spaced apart by at least one of said ribs.

30. The golf club of claim 27 wherein at least a portion of said thinned region is oriented generally parallel to the upper edge portion of said club head.

31. The golf club of claim 29 wherein there are three channel portions that are oriented generally parallel to the upper edge portion of said club head.

32. The golf club of claim 29 wherein when said club head is viewed from the rear, said ribs comprise a central rib disposed between a left rib and a right rib, wherein one of said channel portions is positioned between said left rib and said central rib, and another of said channel portions is positioned between said central rib and said right rib.

33. The golf club of claim 32 wherein the third channel portion is disposed to the side of one of said left rib or said right rib.

34. The golf club of claim 32 wherein said channel portions are elongated and at least some of said channel portions have sides that are generally rectilinear.

35. The golf club of claim 29 wherein the sides of each of said channel portions are generally parallel to each other.

36. The golf club of claim 32 wherein said club head comprises at least one additional channel portion on the back surface of said club head that has curvilinear sides.

37. The golf club of claim 36 wherein the upper edge portion of said club head curves to merge with the toe of said club head, and said additional channel portion is located in the region where the upper edge portion of said club head curves to merge with the toe of said club head.

38. The golf club of claim 29 wherein said thinned region has a length, and at least one rib is oriented generally perpendicular to the length of said thinned region.

39. The golf club of claim 29 wherein at least one channel portion on the back surface of said club head has curvilinear sides.

40. The golf club of claim 29 wherein said channel portions have a length and a width, and said at least one rib has a length, and the length of said channel portions is greater than the length of said at least one rib.

41. The golf club of claim 29 wherein said channel portions have a length and a width, and said at least one rib has a length, and the length of said at least one rib is substantially the same as the width of the channel portions.

42. The golf club of claim 27 wherein said thinned region has a width of about ⅛ inch.

43. The golf club of claim 27 wherein said club face has a center of percussion, and said club face exclusive of any grooves therein defines a plane, wherein said club face has a thickness measured in the region of its center of percussion, and said thinned region has a thickness that is less than that of the club face at the center of percussion, both thicknesses being measured from the plane of the club face to the back surface of the club head.

44. The golf club of claim 29 wherein said channels portions are oriented in an end-to-end configuration with at least one of said ribs therebetween.

* * * * *